United States Patent [19]

Underwood

[11] 4,055,270

[45] Oct. 25, 1977

[54] MULTIPLE CHAMBER PACKAGE

[76] Inventor: J. Larry Underwood, c/o Underwood Mold Co., Inc., 104 Dixie Drive, Dixie Industrial Park, Woodstock, Ga. 30188

[21] Appl. No.: 685,680

[22] Filed: May 12, 1976

[51] Int. Cl.[2] ..... B65D 51/18; B65D 43/06

[52] U.S. Cl. ..... 220/23; 220/256; 220/354; 229/5.7

[58] Field of Search ..... 206/216; 220/23, 284, 220/256, 257, 354; 229/5.7

[56] References Cited

U.S. PATENT DOCUMENTS

| | | | |
|---|---|---|---|
| 1,239,183 | 9/1917 | Hodgson | 220/354 |
| 1,277,724 | 9/1918 | Hodgson | 220/354 |
| 1,847,245 | 3/1932 | Hothersall | 220/354 |
| 2,606,685 | 8/1952 | Erb | 220/354 |
| 2,979,193 | 4/1961 | Fredette | 206/216 |
| 3,046,853 | 7/1962 | Legenore | 220/284 |
| 3,262,600 | 7/1966 | Gach | 220/284 |
| 3,360,153 | 12/1967 | Wheaton, Jr. | 220/256 |
| 3,417,895 | 12/1968 | Penton | 220/23 |
| 3,506,459 | 4/1970 | Parlour | 220/23 |

FOREIGN PATENT DOCUMENTS

| | | | |
|---|---|---|---|
| 1,558,624 | 1/1969 | France | 206/216 |
| 629,306 | 11/1927 | France | 220/284 |

*Primary Examiner*—William Price
*Assistant Examiner*—Bruce H. Bernstein
*Attorney, Agent, or Firm*—Littlepage, Quaintance, Murphy, Richardson & Webner

[57] ABSTRACT

A tamper-proof multiple chamber package includes a can or container with a top or lid and a concave cap connected to the lid. A lid receiving ring is mounted on the upper edge of the container and includes a seam, a recessed platform, and a countersunk annular groove. The lid includes a downwardly extending annular protrusion for insertion into the groove with a friction fit and a rim positioned outwardly of the protrusion. The cap includes a downwardly extending annular flange with an inwardly protruding bead that is snapped about the rim of the lid, so that the cap and lid are connected together, the lid and cap are mounted on the can and the edge of the cap is confined inside the seam of the ring, where the cap cannot be pried loose from the can.

5 Claims, 4 Drawing Figures

MULTIPLE CHAMBER PACKAGE

BACKGROUND OF THE INVENTION

This invention relates generally to special recpetacles and packages, more particularly to a multiple chamber package where tow separate products can be separately stored and exhibited for sale.

In the sale of certain products, it is desirable to package and exhibit the principal project wit ha separate product which mught be desirable or required to have for sale with the principal product. For example, certain products are sold with "premiums" and other sales promotion articles to enhance the sale of the principal product. As with the particular embodiment of the invention disclosed herein, another example would be the sale of a adhesive together with a hardener. When certain adhesives or puttys are sold, it is necessary to sell a hardener with the substance so thatthe purchaser will nt inadverently purchase only the putty or the adhesive without purchasing the hardener.

It is sometimes difficult for the retail merchant to keep the hardener or other attached item that is to be sold with the principal item because of pilfering by customers. The prior art combination containers typically comprise a base container such as a metal can that contains putty or some other principal commodity, and a plastic cap mounted on the top of the container which contains a tube or other small container filled with hardener, or some other necessary or attractive item. Customers as well as other people about retail stores frequently remoe the cap from a base container and take the hardener, etc. This leaves the retail merchant with only the basic commodity to sell, which in most cases, cannot be sold withut the item that was contained in the cap.

SUMMARY OF THE INVENTION

Briefly described, the present invention comprises a multiple chamber container for storing and displaying separate items. A base or main container comprises a tubular side wall closed at its lower end with a bottom wall and closed at its upper open end with a removable lid. A lid or closure member receiving ring is mounted within the upper open edge of the side wall of the base container and includes a seam connected to the side wall of the base container, a platform downwardly recessed or spaced from the seam, and a groove in the ring recessed or countersunk from the platform. The lid or closure member includes an annular protrusion which mates with the annular groove of the ring with a friction fit and a rim. The auxiliary container cap which fits over the upper portion of the base or main container includes a laterally extending cap platform which engages the rim of the lid or closure member downwardly extending flange or wall formation which projects between the wall or seam of the ring at the open end; and the lid, or clusure member and an annular or peripheral bead which extends inwardly from the flange or wall and fits about the rim of the lid. The flange or wall extends into the of the base container, at its open end inwardly of the seam of the ring of the container, so that a person cannot reach the inner edge of the cap to prise the cap from the container. The annular bead locks about the rim of the lid, and the wall of the container or seam of the ring prevents the flange of the cap from being moved away from the rim of the lid, thus making it virutally impossible to remove the cap without also removing the lid or closure member.

Thus, it is an object of this invention to provide a tamper-proof combination package where a cap or auxiliary container is mounted over the lid or closure member of a main container for storing an article or substane separately from the article a material stored in the base container.

Another object of this invention is to provide an inexpensive cap or auxiliary container in combination with a base container which is difficult to remove from the base container.

Another object of this invention is to provide a cap or auxiliary container for mounting on the lid or closure member of a container, which locks to the lid of the container without impairing the closing and locking function of the lid with respect to the base container.

Other objects, features and advantages of the present invention will become apparent upon reading the following specification, when taken in conjunction with the accompanying drawing.

DETAILED DESCRIPTION

Figure 1:
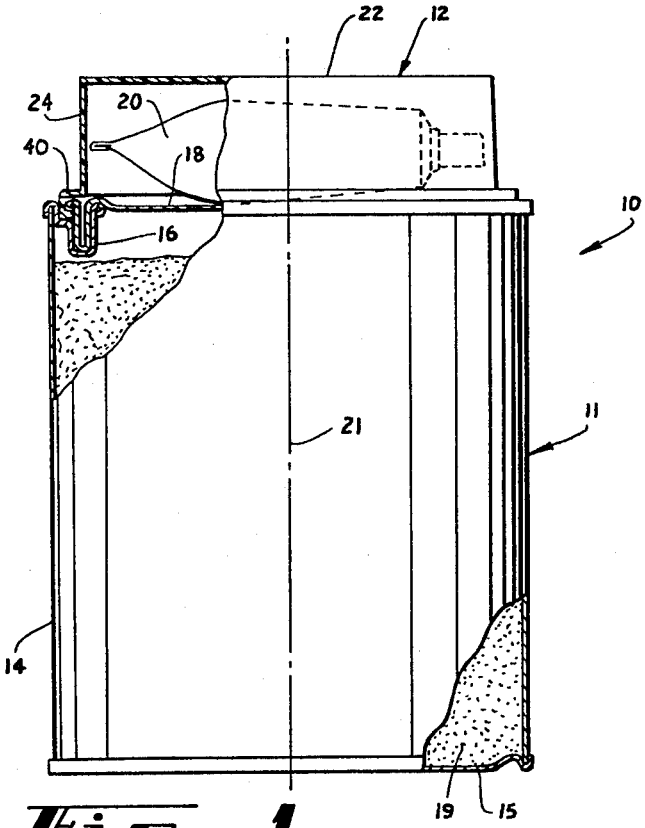
FIG. 1 is a partial side elevational view of the multiple chamber package, with portions broken away to show the details of the lid, cap and lid-receiving ring.

Referring now in more detail to the drawing, in which like numerals indicate like part throughout the several views, FIG. 1 illustrates a multiple chamber package 10 which includes a base of main container 11 and a cap or auxiliary container 12. The base or main container 11 includes a tubular side wall 14, a bottom wall 15, a lid receiving ring 16, and a lid or closure member 18 closes the top opening of the base container. Putty, adhesive or some other commodity or article 19 is stored in the base or main container 11, while a hardener 20 or some other separate article or substance is stored in the cap 12. The base or main container 11 is essentially cylindrical or bucket shaped with a longitudinal axis 21, and the lid of closure member receiving ring 16 is essentially circular and concentric with respect to the axis 21. The cap or auxiliary member is concave and includes a disc shaped to wall 22 and a downwardly extending tubular side wall 24 which are concentric with respect to logitudinal axis 21 when the cap is positioned on the container as shown.

Figure 3:
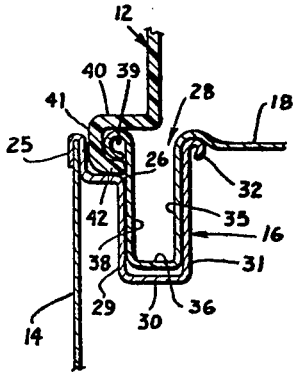
FIG. 3 is an assembled detail illustration of portions of the cap, lid and lid-receiving ring.
Figure 2:
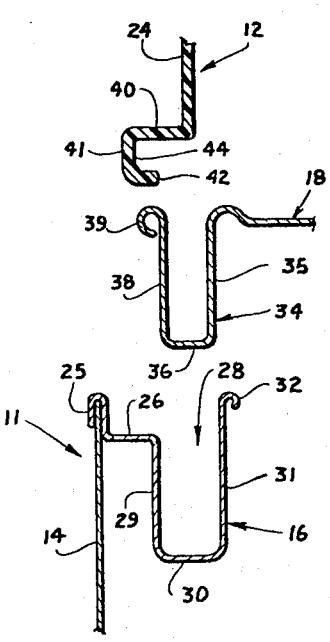
FIG. 2 is an exploded detail illustration of portions of the cap, lid and lid-receiving ring.

As best shown in FIGS. 2 and 3, the lid receiving ring or ledge 16 of the base container 11 includes a seam 25 soldered or crimped about the upper end of the tubular side wall 14 of the container, a peripheral platform portion 26 recessed downwardly of spared axially inwardly with respect to the seam 25, at the open end and annular locking groove 28 formed by out leg 29, bottom leg 30 and inner leg 31 of the ring 16. The upper edge of the inner leg 31 is formed in a rolled inner rim 32. The annualr groove 28 is countersunk or recessed axially inwardly with respect to platform 26, and the annular groove 28 is positioned radially inwardly from the platform 26 and the platform 26 is positioned on the wall of the container radially inwardly from the seam 25 at the open end.

Lid or closure member 18 is approximately disc shaped and includes downwardly or inwardly axially extending member lock protrusion 34 formed by inner leg 35, bottom leg 36 and outer leg 38. The upper edge of the annular outer leg 38 terminates in the outwardly and downwardly projecting rolled outer rim 39. The annular protrusion 34 is of a thickness compatible with the width of the annular groove 28 of ring 16 so that the protrusion 34 can be inserted into the groove 28 with a friction fit. As illustrated in FIG. 3, the height of the protrusion 34 and the depth of the annular groove 28 are such that the rim 39 of the lid 18 will overlie and by spaced just slightly above the ring platform 26 when the lid or closure member is fully inserted into the lid receiving ring 16.

The downwardly extending annular side wall 24 of cap 12 terminates in a radially outwardly extending annular platform 40 which is of a radius and width sufficient to rest upon the upper surface 50 of rim 39 of lid 18, and the platform 40 is turned down at its outer edge into an axially inwardly extending annular flange or wall formation 41. Annular bead formation 42 is spaced from platform 40 and extends radially inwardly from the flange or wall formation 41, and with the flange 41 and platform 40, forms a locking groove or channel 44. Locking groove 44 is an annular groove which extends about the cap and has a diameter approximately equal to the outside diameter of rim 39 of lid or closure member 18 and a radius compatible with the rolled curvature of rim 39. Thus, cap 12 can be forced against lid 18 and the bead 42 will move about the curve outer rolled rim 39 of the lid so that the locking groove 44 of the cap registers with and extends about the rim 39 of lid 18 until the platform 40 contacts the outer axial surface 50 f the rim 39.

As is illustrated in FIG. 3, the outside diameter of rim 39 of lid 18 is less than the inside diameter of the seam 25 of the ring 16, which leaves an annular space between the lid or closure member 18 and the seam 25 of ring 16 or wall at the open end of the container when the lid is inserted into the ring 16. The thickness of the axially inwardly extending flange or wall formation 41 of cap 12 closely fits rim 39 and occupies the space between the lid 39 and seam 25, and these elements are shaped and proportioned so that a relatively tight fit is achieved. Thus, because of the presence of seam 25 outside the flange 41, the flange or wall formation 41 cannot be forced radially outwardly with respect to the lid a closure member 18 which prevent bead 42 from being withdrawn from beneath rim 39 of the lid 18, which positively lock the cap 12 to the lid 18.

Figure 4:
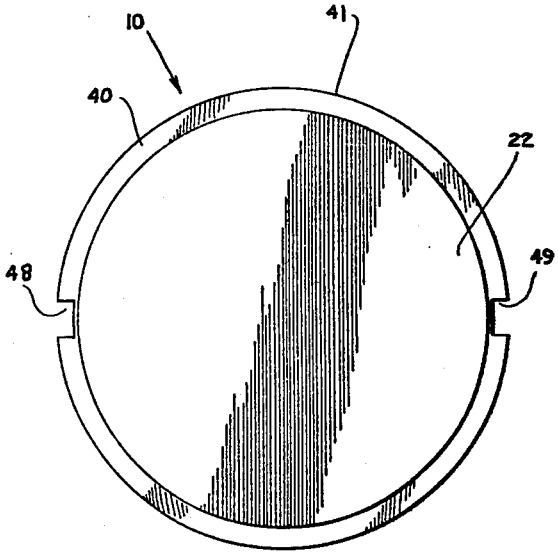
FIG. 4 is a top view of the cap.

As illustrated in FIG. 4, the cap or auxiliary container 12 defines at least one notch or discontinuity 48 at its edge through platform 40, flange 41 and bead 42. The embodiment illustrated, two notches or discontinuities 48 and 49 are illustrated. The notches are of a width sufficient to allow the head of a screw driver or similar prying instrument to be inserted over the seam 25 of the ring 16 and beneath the rim 39 of lid 18, the pry the lid away from the ring. Thus, the lower chamber of the base or main container can be opened by removing the lid or closure member 18 and cap or auxiliary container 12 simultaneously. Once the lid and cap have been removed, the screw driver can be inserted through a notch 48 or 49 of the cap between the cap and the lid to pry the cap away from the lid. While two notches 48 and 49 have been disclosed, it will be understood that the number of notches can be varied as desired by the manufacturer, with the number of notches depending upon how secure the container should be formed, and by other considerations.

In the embodiment illustrated, the base container 11 and lid 18 are fabricated from such metal as aluminum, steel, tin etc., and the cap 12 from a plastic such as polystyrene, polyethylene, polypropylene; however, while this invention has been described in detail with particular reference to preferred embodiments thereof, it will be understood that variations and modifications can be effected within the spirit and scope of the invention as decribed hereinbefore and as defined in the appended claims.

1. An assembly of two container in which an auxiliary container is connected to a first container and it closure member, comprising a first container having an open end bordered by an outer wall, a closure member closing said first container, said closure member and first container having interengaging means to secure said closure member to said first container radially inwardly of said outer wall, said closure member having a radially outwardly projecting rim, a second auxiliary container having an open end bounded by a wall formation, said wall formation surrounding and closely fitting said rim and have a peripherally extending bead formation projecting radially inwardly from the periphery of said wall formation at said open end and underlying said rim, said wall formation at the open end of said second container closely fitting in the wall at the open end of said first container and being confined between said rim and said wall at the open end of said first container, said rim of said closure member overlying said bead formation to prevent separation of said containers when said closure member is secured to said first container.

2. An assembly as claimed in claim 1 in which said wall formation and bead formation of said second container have discontinuities at a plurality of points, the open end of said second container having an internal radially opening channel formed by said bead formation and wall formation and a radial wall element spaced from said bead formation, said channel receiving said rim of said closure member.

3. An assembly in which an auxiliary container is connected to a main container and its closure member, comprising a main container having an open end bordered by an outer wall with an internal peripheral abutment on said outer wall spaced axially inwardly from the open end, a closure member frictionally engaging said main container radially inwardly of said abutment to close said main container, said closure member having a radially outwardly projecting rim overlying said peripheral abutment when said closure member engages and closes said main container, an auxiliary container having an open end bounded by a wall formation connected to said closure member, said wall formation surrouding and closely fitting said rim on said closure member and having a peripherally extending bead formation projecting radially inwardly from the periphery of said wall formation at said open end, said auxiliary container having a radial spaced from said bead formation and extending radially inwardly from said wall formation and over said rim so that said rim is confined in a channel formation between said bead formation and said platform to connect said auxiliary contained to said closure member, said wall formation at the open end of said auxiliary container closely fitting in the wall at the open end of said main container and being confined between said rim of said closure member and said wall at the open end of said main container, said bead formation being confined between said rim and said abutment on said main container, so that said auxiliary container is held against removal from said closure member and main container when said closure member engages and closes said main container.

4. An assembly of two containers in which an auxiliary container is connected to a main container and its closure member, comprising a main container having an open end bordered by an outer wall and having an internal ring at said open end with its internal periphery spaced from the wall of said container by an internal peripheral abutment on said wall, a closure member having an axially projecting annular protrusion frictionally fitting in said ring to close the open end of said main container, said closure member having a rim projecting radially outwardly from said protrusion and overlying said peripheral abutment, an auxiliary container having an open end bordered by a peripheral wall formation, said wall formation surrounding and closely fitting said rim on said closure member and having a peripherally extending bead formation projecting radially inwardly from the peripery of said wall formation at said open end and underlying said rim, said auxiliary container having a radial platform axially spaced from said bead formation and extending inwardly from said wall formation to form a channel receiving the rim of said closure member to connect said auxiliary container to said closure member, said wall formation and said bead formation having discontinuities at a plurality of points about the periphery to form a sectional wall formation and bead formation, said wall formation at the open end of said auxiliary container closely fitting in the wall at the open end of said main container and confined between said rim and said wall at the open end of said main container, said bead formation being confined between said rim and said abutment to connect said auxiliary container to said closure member and said main container, so that said auxiliary container cannot be separated from said main container when said closure member engages and closes said main container.

5. An assembly of two containers in which an auxiliary container is connected to a main container and its closure member, comprising a main container having an open end bordered by an outer wall and having an internal ring at said open end with an axially outwardly opening groove about its internal periphery spaced from the wall of said container by an internal peripheral abutment on said wall, a closure member having an axially projecting annular protrusion frictionally fitting in the groove in said ring to close the open end of said container, said closure member having a rim projecting radialy outwardly from said protrusion and overlying said peripheral abutment, an auxiliary container having an open end bordered by a peripheral wall formation, said wall formation surrounding and closely fitting said rim on said closure member and having a peripherally extending bead formation projecting radially inwardly from the periphery of said wall formation at said open end and underlying said rim, said auxiliary container having a radial platform axially spaced from said bead formation and extending inwardly from said wall formation to form a channel receiving the rim of said closure member to connect said auxiliary container to said closure member, said wall formation, bead formation and platform having discontinuities at a plurality of points about the periphery formed by notches extending through said bead and wall formation and into said platform, so that a tool may be inserted in a notch to engage the rim on said closure member and pry said closure member off the main container, said wall formation at the open end of said auxiliary container fitting in the wall at the open end of said main container and confined between said rim and said wall at the open end of said main container, said bead formation being confined between said rim and said abutment to connect said auxiliary container to said closure member and said main container, so that said auxiliary container cannot be separated from said main container when said closure member engages and closes said main container.

* * * * *

UNITED STATES PATENT AND TRADEMARK OFFICE

CERTIFICATE OF CORRECTION

PATENT NO. : 4,055,270

DATED : October 25, 1977

INVENTOR(S) : J. Larry Underwood

It is certified that error appears in the above-identified patent and that said Letters Patent are hereby corrected as shown below:

Column 1, Line 7 change "tow" to --two--.
Column 1, Line 10, change "wit ha" to --with a--.
Column 1, Line 19, insert a space between "that" and "the."
Column 1, Line 20 change "nt" to --not--.
Column 1, Line 33 change "remoe" to --remove--.
Column 1, Line 36 change "withut" to --without--.
Column 1, Line 53 after "container" insert --or--.
Column 1, Line 56 after "member" insert --, a--.
Column 1, Line 59 change "clusure" to --closure--.
Column 1, Line 62 after "the", first occurence, insert --wall--; after "container" delete ","; after "end" insert --,--.
Column 2, Line 1 delete "virtally" and insert --virtually--.
Column 2, Line 4 change "where" to --wherein--.
Column 2, Line 6 change "substane" to --substance--.
Column 2, Line 7 change "a" to --or--.
Column 2, Line 37 change "of" to --or--.
Column 2, Line 47 change "of" to --or--.
Column 2, Line 50 change "to" to --top--.
Column 2, Line 52 change "longitadinal" to --longitudinal--.
Column 2, Line 58 change "of" to --or--; change "spared" to --spaced--.
Column 2, Line 59 delete "," after "25" and insert --,-- after "end".
Column 2, Line 60 change "out" to --outer--.
Column 2, Line 63 change "annualr" to --annular--.
Column 3, Line 3 should read --extending annular locking protrusion 34 formed by inner--.
Column 3, Line 6 should read --projecting and downwardly rolled outer rim 39. The--.

UNITED STATES PATENT AND TRADEMARK OFFICE

CERTIFICATE OF CORRECTION

PATENT NO. : 4,055,270
DATED : October 25, 1977
INVENTOR(S) : J. Larry Underwood It is certified that error appears in the above-identified patent and that said Letters Patent are hereby corrected as shown below:

Column 3, Line 12 change "by" to --be--.
Column 3, Line 26 insert --or channel-- after "groove".
Column 3, Line 35 change "f" to --of--.
Column 3, Line 47 before "outside" insert --or wall of container 11--.
Column 3, Line 49 change "a" to --or--; change "prevent" to --prevents--.
Column 3, Line 51 change "lock" to --locks--.
Column 3, Line 54 insert --In-- after "42"; change "The" to --the--.
Column 4, Line 15 change "it" to --its--.
Column 4, Line 25 change "have" to --having--.
Column 4, Line 60 insert --platform-- after "radial".
Column 6, Line 14 change "radialy" to --radially--.

Signed and Sealed this

Ninth Day of May 1978

[SEAL]

Attest:

RUTH C. MASON
Attesting Officer

LUTRELLE F. PARKER
Acting Commissioner of Patents and Trademarks